US011536505B2

(12) United States Patent
Garg

(10) Patent No.: US 11,536,505 B2
(45) Date of Patent: Dec. 27, 2022

(54) COLD STORAGE SYSTEM FOR TRANSPORT

(71) Applicant: Innovation Thru Energy Co., Ltd., Tokyo (JP)

(72) Inventor: Pankaj Kumar Garg, Tokyo (JP)

(73) Assignee: Innovation Thru Energy Co., Ltd., Tokyo (JP)

( * ) Notice: Subject to any disclaimer, the term of this patent is extended or adjusted under 35 U.S.C. 154(b) by 671 days.

(21) Appl. No.: 15/766,302

(22) PCT Filed: Mar. 14, 2016

(86) PCT No.: PCT/IB2016/000281
§ 371 (c)(1),
(2) Date: Apr. 5, 2018

(87) PCT Pub. No.: WO2017/060760
PCT Pub. Date: Apr. 13, 2017

(65) Prior Publication Data

US 2018/0283763 A1 Oct. 4, 2018

(30) Foreign Application Priority Data

Oct. 9, 2015 (IN) ..... 3256/DEL/2015

(51) Int. Cl.
*F25D 11/00* (2006.01)
*F25D 17/04* (2006.01)
*F25D 23/06* (2006.01)

(52) U.S. Cl.
CPC ..... *F25D 11/006* (2013.01); *F25D 11/003* (2013.01); *F25D 17/045* (2013.01);
(Continued)

(58) Field of Classification Search
CPC .... F25D 11/006; F25D 11/003; F25D 23/068; F25D 17/047; F25D 17/045; F25D 17/06;
(Continued)

(56) References Cited

U.S. PATENT DOCUMENTS

2004/0020236 A1* 2/2004 Vince, II ..... B60P 3/20 62/434

FOREIGN PATENT DOCUMENTS

CA 2108773 A1 11/1992
JP 1-174874 A 7/1989
(Continued)

OTHER PUBLICATIONS

English Translation of JP-11132623-A (Year: 2019).*
International Search Report for PCT/IB2016/000281 dated Jun. 21, 2016.

*Primary Examiner* — Elizabeth J Martin
(74) *Attorney, Agent, or Firm* — Knobbe Martens Olson & Bear LLP

(57) ABSTRACT

The present invention is directed to a system (100) maintaining chilled temperature in a cold storage (102) comprising: a plurality of coolant layers 104 uniformly placed on the roof of said storage (102); each coolant layer comprising multiple coolant plates (106) stacked in rows and columns; a compressor (110) generating airflow and circulating airflow in a circular pattern from top to bottom in said (storage 102); thereby maintaining temperatures in the range −25° C. to +25° C. in said storage; said plurality of coolant layers (104) being placed in close proximity to said compressor (110) for effectively circulating airflow; a coolant holder frame (108) for uniformly adjusting said multiple coolant plates (106) in said plurality of coolant layers (104), and allowing efficient airflow from top to bottom in said storage (102); base of said storage being provided with, holes (112), throughout for sucking the air circulated by said compressor
(Continued)

(110) to improve the circulation of airflow in said storage (102); and said storage (102) being insulated to increase the thermal insulation coefficient to maintain the desired temperature in said storage, thereby freezing said coolant layers.

7 Claims, 6 Drawing Sheets

(52) U.S. Cl.
CPC ..... *F25D 17/047* (2013.01); *F25D 23/068* (2013.01); *F25D 2400/30* (2013.01)

(58) Field of Classification Search
CPC . F25D 2400/30; F25D 2317/06; F25D 19/003
See application file for complete search history.

(56) References Cited

FOREIGN PATENT DOCUMENTS

| | | | | |
|---|---|---|---|---|
| JP | 11-132623 | A | | 5/1999 |
| JP | 11132623 | A | * | 5/1999 |
| JP | 2014-206289 | A | | 10/2014 |
| WO | WO 2010/091181 | A1 | | 8/2010 |
| WO | WO 2013/187997 | A1 | | 12/2013 |

* cited by examiner

COLD STORAGE SYSTEM FOR TRANSPORT

CROSS REFERENCE TO RELATED APPLICATIONS

This application is a U.S. National Phase Application of PCT International Application Number PCT/IB2016/000281, filed on Mar. 14, 2016, designating the United States of America and published in the English language, which is an International Application of and claims the benefit of priority to Indian Patent Application No. 3256/DEL/2015, filed on Oct. 9, 2015. The disclosures of the above-referenced applications are hereby expressly incorporated by reference in their entireties.

TECHNICAL FIELD

The present invention generally relates to the field of cold containers, and particularly, to a system maintaining chilled-frozen and constant temperature in the cold storage during cold chain transportation.

BACKGROUND

The cold containers and/or the storages are widely used for variety of industrial and consumer purposes i.e., transporting the goods over long geographic distances. The cold containers in today's rapidly growing world possess applications in almost every sphere of life and vary across the industries. The continuous and long working of cold containers require large amount of working and cooling efficiency, thus resulting in greater demand for power generation and resulting a huge amount of emission of $CO_2$.

In addition, there are encountered severe design complications in the designing and manufacturing of the cold storages required to cater to different needs of different industries. The design of the cold containers form a critical aspect in ascertaining the efficiency associated with the operation of the cold storages. Most important deficiency is that there is no uniform airflow in the conventional cold containers resulting in temperature differential.

Also, the conventional cold containers of the type as known in the art have high designing and manufacturing costs associated with them, thus, making the manufacturers inclined towards adopting such designs which are not competitive in the context of the purposes they are required to serve. Thus, the complex, unresolved, and costly design parameters of the cold storages results in the loss of efficiency and hence, making a huge loss to the industries and the economy on the whole.

Therefore in view of foregoing, there is an exigency of a new, improved, simplified, and cost-effective cold storage that takes care of all the aforesaid technical, safety, and cost-related constraints without affecting the cooling efficiency and other performance related parameters.

SUMMARY OF THE INVENTION

It is an object of the present invention to maintain chilled\frozen temperature inside the cold storage.

It is another object of the present invention to arrange coolant layers on the roof of the cold storage.

It is yet another object of the present invention to incorporate the compressor at the top for freezing the coolant layer thereby generating and circulating uniform airflow in the storage.

It is yet another object of the present invention to position the coolant layers adjacent to the compressor for effectively circulating airflow in the cold storage.

It is, yet another object of the present invention to have a coolant holder for uniformly adjusting coolant plates and allow efficient airflow from top to bottom in the cold storage.

It is yet another object of the present invention to provide holes at the base of the cold storage.

It is a further object of the present invention to insulate the cold storage for maintaining desired temperature in the cold storage.

The present invention relates to a system maintaining chilled/frozen temperature in a cold storage. The system is formed of a plurality of coolant layers which are uniformly placed on the roof of the storage. Each coolant layer includes multiple coolant plates stacked in rows and columns. The system further incorporates a compressor generating airflow and circulating airflow in a circular pattern from top to bottom in the cold storage; and maintaining temperatures in the range −30° C. to +25° C. in the storage. The plurality of coolant layers are placed in close proximity to the compressor for effectively circulating airflow. The system also provides a coolant holder frame for uniformly adjusting the multiple coolant plates in the plurality of coolant layers, and thus, allowing for efficient airflow from top to bottom in the storage. Further, the base of the storage is provided with holes throughout the area for sucking the air circulated by the compressor in order to improve the circulation of airflow in the storage. Also, the cold storage is insulated to increase the thermal insulation coefficient to maintain the desired temperature in the storage, thereby freezing the coolant layers.

The Compressor airflow circulate the frozen air in order to freeze the coolant; once the coolant get frozen. Also, the air temperature in the system depend, upon the coolant freezing point. Once coolant is completely frozen, compressor stops and coolant start realizing energy depending upon the coolant's freezing point; it could chilled or frozen. Further, the Coolant holder frame is design in such a way that it not only holds the coolant but also allows coolant realize energy from top to bottom.

In one embodiment of the present invention, the plurality of coolant layers is rectangular shaped.

In another embodiment of the present invention, the plurality of coolant layers have dimensions 40 cm*30 cm*3.5 cm.

In another embodiment of the present invention, there are two coolant layers placed on the roof of the storage.

In another embodiment of the present invention, there are three coolant layers placed on the roof of the storage.

In another embodiment of the present invention, each layer of the plurality of coolant layers comprises eighty plates.

In another embodiment of the present invention, the coolant holder frame is a stainless steel frame.

In yet another embodiment of the present invention, the cold storage is cold chain logistics, cold container, refrigerated container; and chilled or frozen cold storage.

BRIEF DESCRIPTION OF ACCOMPANYING DRAWINGS

A further understanding of the present invention can be obtained by reference to various embodiments set forth in the illustrations of the accompanying drawings. The drawings are not intended to limit the scope of the present invention, which is set forth with particularity in the claims as appended or as subsequently amended, but merely to clarify and exemplify the invention.

For a more complete understanding of the present invention, reference is now made to the following drawings wherein:

FIG. 1 is a diagrammatic representation of a system 100 and a container 102 provided with holes 112 in accordance with an embodiment of the present invention.

FIG. 2 is a schematic representation illustrating coolant layers 104 having coolant plates 106 therein arranged in a coolant holder frame 108 in accordance with an embodiment of the present invention.

DETAILED DESCRIPTION OF THE INVENTION

Figure 1:
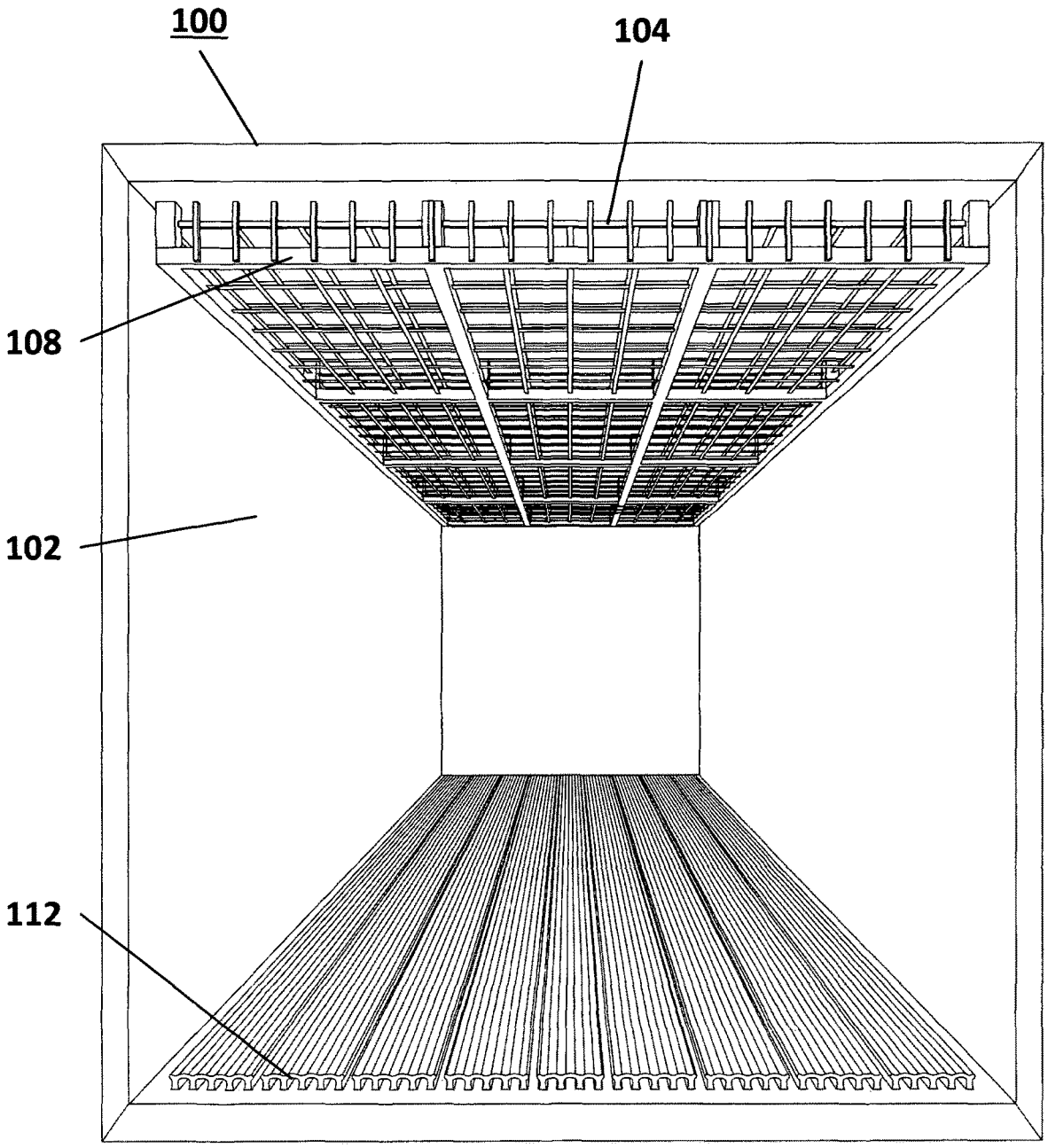

The following presents a detailed description of various embodiments of the present invention with reference to the accompanying drawings.

The embodiments of the present invention are described in detail with reference to the accompanying drawings. However, the present invention is not limited to these embodiments which are only provided to explain more clearly the present invention to the ordinarily skilled in the art of the present disclosure. In the accompanying drawings, like reference numerals are used to indicate like components.

The present invention relates a cold storage system for maintaining chilled or frozen temperature during transport. Further, the invention relates to a hybrid container involving the use of a coolant to keep the container at a desired temperature at all times i.e., even after the compressor has stopped working. The positioning of the coolant in the container forms a key aspect of the present invention and helps achieve the objective of maintaining the chilled temperature inside the container.

The terms "container" and the "cold storage" have been used interchangeably in the context of the present invention, and are not supposed to be misunderstood in construing the meaning and scope of the subject matter forming a part of the present invention.

Referring to an embodiment of the present invention, the present invention in its best form describes a system 100 as shown in FIG. 1 that helps maintain chilled temperature in the cold storage.

The cold storage 102 as described hereinbefore and hereinafter in the present invention refers to the multitude of things including, but not limited to, cold chain logistics; cold container; refrigerated container; chilled or frozen cold storage.

The present invention in the preferred embodiment describes the system for a 20 F container as shown in FIG. 1. However, the concept underlining the system of the present invention is not limited to any particular size of the container, and can well be systematize to cater to any other size of the container as can be apprehended by a person skilled in the art.

According to an embodiment of the present invention, the system 100 is formed with a plurality of coolant layers 104. Each coolant layer of the plurality of coolant layers is rectangular shaped, having dimensions 40 cm*30 cm*3.5 cm. However, the shape and size of the coolant layers can vary as per the requirement and design of the cold storage, and as can be perceived by a person skilled in the art. The coolant layers are uniformly placed on the roof of the cold storage covering the entire roof, with each coolant layer having multiple coolant plates 106 stacked in rows and columns as shown in FIG. 3.

The cold storage system in its preferred embodiment makes use of at least two and preferably three coolant layers with each coolant layer having as several units of coolant plates to cover the entire area therein. However, the number of coolant layers 104 provided on the roof of the cold storage 102 and the coolant plates 106 forming the coolant layers are not restricted to the one's as described herein, but there can be any number of coolant layers and coolant plates as required by the system (depending on the factors such as size of the container) and perceived by the person skilled in the art such that the objective of effectively cooling the cold storage is met without any compromise.

Figure 3:
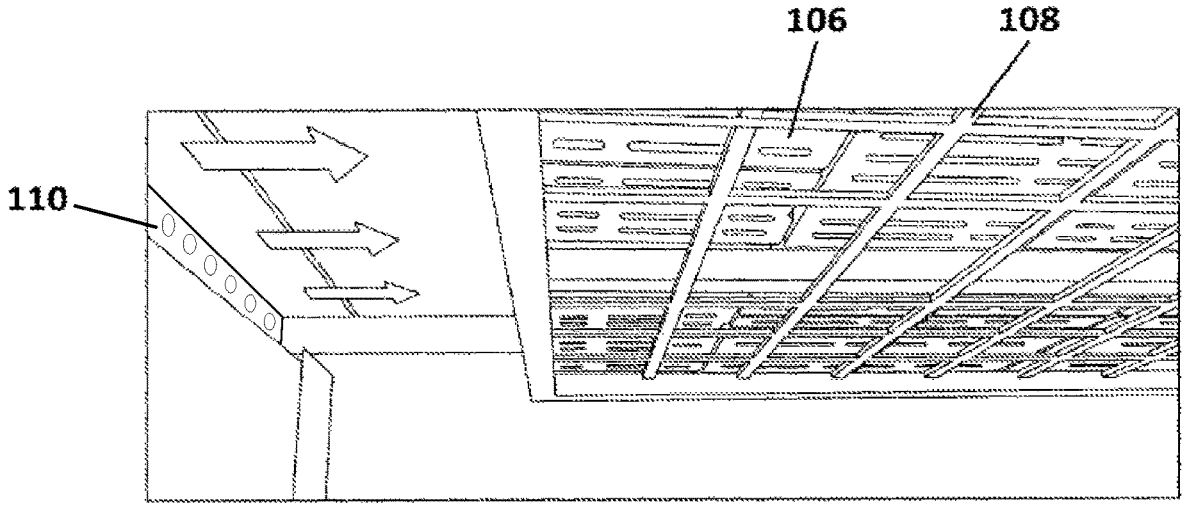
FIG. 3 represents an airflow from a compressor 110 in the system 100 in accordance with an embodiment of the present invention.

It is in accordance to an embodiment of the present invention that the coolant plates 106 are adjusted uniformly and held intact in the coolant layers 104 with the help of a coolant holder frame 108 as shown in FIG. 3. This configuration of the system 100 helps allow efficient airflow from top to bottom in the cold storage. The coolant holder frame is a stainless steel frame and, can also be made up of any other suitable material as can be conceived by a person skilled in the art without compromising the intent of having the coolant holder frame as described hereinabove.

Figure 4:
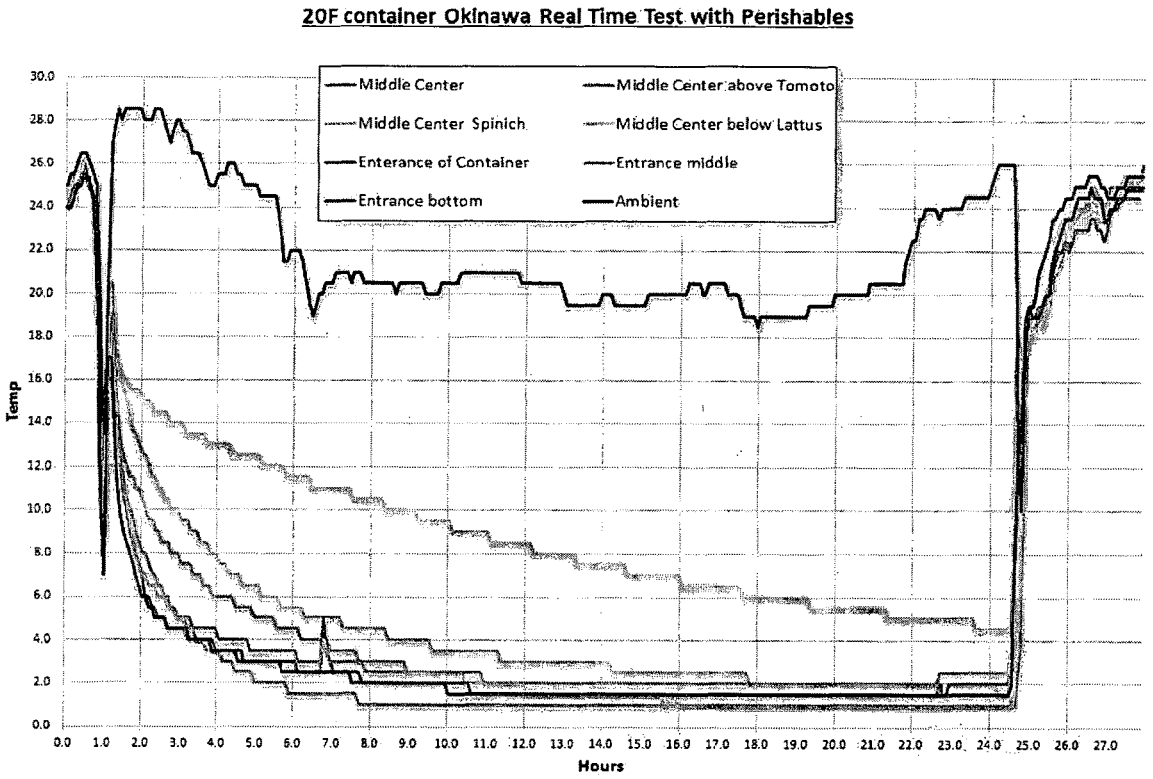
FIG. 4 represents tests results with perishable goods

Referring to an embodiment of the present invention as shown in FIG. 4, airflow in the cold storage 102 is generated or supplied using a compressor 110 of the type as known in the art. The compressor 110 is placed on the roof of the container and is capable of running on external power sources such as, power generator to freeze/charge the coolant layers positioned on the roof of the container.

The compressor 110 generates airflow at an increased pressure and at −30° C. temperature. The circulation of the cool energy in the form of airflow supplied by the compressor starts right from the compressor top roof back and circulated in a circular pattern from top roof back to top roof front, and to the bottom of the cold storage. The compressor as employed in the system of the present invention is capable of maintaining the temperature of the cold storage in the range −30° C. to +25° C.

Figure 2:
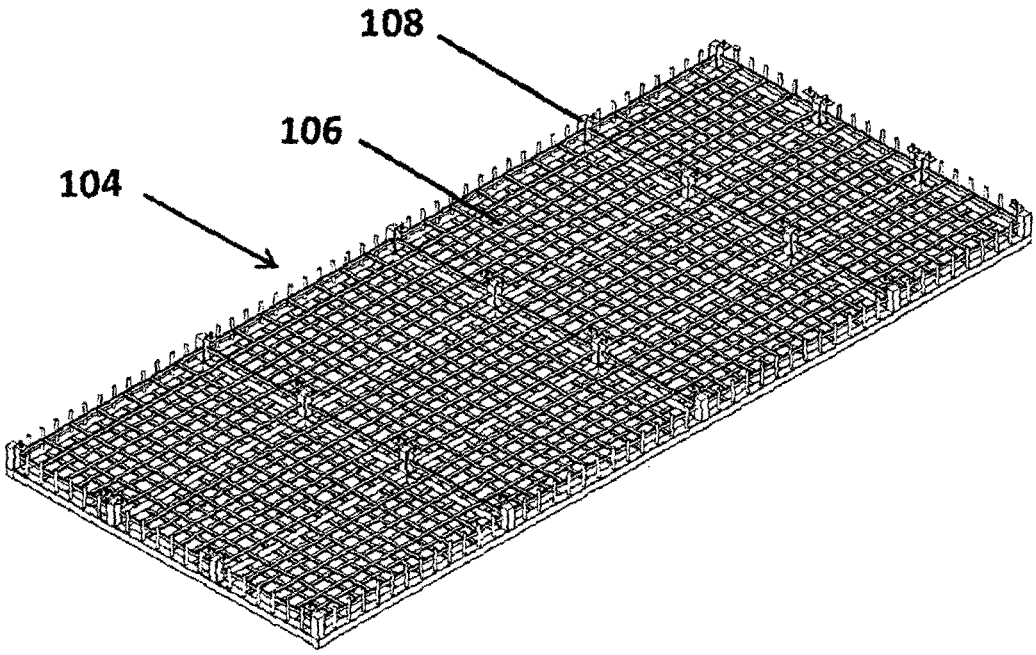

It is in furtherance to an embodiment of the present invention that the base of the cold storage is provided with holes 112 throughout as shown in FIG. 2. The airflow circulated from the top of the cold storage to the bottom of the cold storage is sucked by the holes placed all over the base and resulting in an improved and efficient circulation of the airflow in the entire cold storage.

Referring FIG. 4, the position of the coolant layers 104 with respect to the compressor 110 forms a key aspect of the system of the present invention as described herein. The coolant layers 104 spreading all over the roof of the container 102 are located close to the compressor 110. This position of the coolant layers in vicinity of the compressor helps freeze the coolant layers to its freezing temperature at an exceptional rate and thus, allows for quick and efficient cooling of the cold storage. Once the coolant layers are frozen; the compressor can be stopped, and there is efficient circulation of the airflow in the entire cold storage owing to the configuration of the system as employed herein i.e., the position of the coolant layers, and the holes spread all over the base of the cold storage. The container can therefore, work as a chilled container for many days to come until the coolant layers gets fully discharged or loses their cooling capacity received from the airflow generated by the compressor.

According to an embodiment of the present invention, the system allows for insulation of the cold storage. The thickness of the insulating material used is approximately 50~90 mm more than what is used in the conventional cold storages. This helps in increasing the insulation thermal k value, and thus resulting in improved efficiency of the system.

The system as provided in the present invention is a breakthrough concept having easy and simple installation as illustrated hereinabove. The focus markets for the cold storage described hereinabove being the cold chain logistics in the area of sea, train and truck, in addition to use as preservation chilled\frozen container. The new usages of this invention bring a capability where for example a 20 Feet or any other sized container with these capabilities could support frozen and chilled temperature without power sources while on move in train/sea/trailer. The present system also offers varying other significant applications, such as, "it could work as stationary/mobile preservation device; used in emergency situations viz., in disaster backup or management for providing sufficient food supply & preservation."

It is to be understood that the above described embodiments are merely illustrative principles of the present invention and that many variations may be devised by those skilled in the art without departing from the scope of the present invention. It is, therefore, intended that such variations be included with the scope of the claims.

EXAMPLES

Example 1

Testing the Performance of the Cold Storage System With Perishable Goods

The testing of the performance of the cold storage system was done by placing sensor at various places in the inside the container. The specific points where the sensors were placed are as follows:

Middle center of the container

Middle center of Spinach

Middle center above Tomato

Middle center below Lettuce

Entrance of container

Entrance middle

Entrance bottom

Outside container for determining ambient temperature

The test was conducted by Okinawa government officials in order to ensure industry standard as perishables cold chain is reliable/industry standard and meets industry compliance.

The data was measured with respect to the temperature at various points at different temperatures. The graph was then prepared with the data collected with time plotted at X-axis and temperature at Y-axis. The said graph is represented in FIG. 4.

It was found that invariably the temperature within the container remained constant over a twenty four hours.

Example 2

Testing the Performance of the Cold Storage System by Measuring Temperature

The testing of the performance of the cold storage system was done by placing sensor at various places in the inside the container. The specific points where the sensors were placed are as follows:

Front top, front middle and front down,

Middle top, center middle and middle down,

Back top, back middle and back down,

Outside the container.

Figure 5:
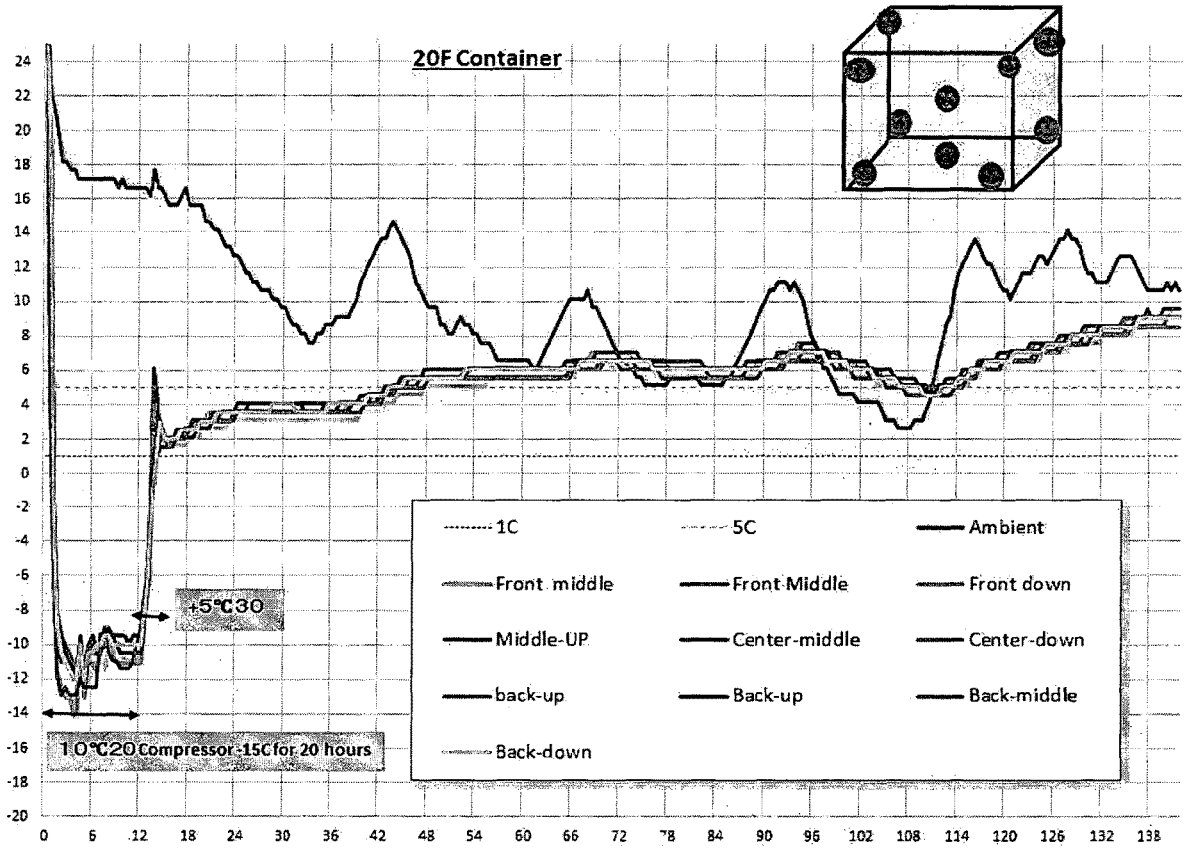
FIG. 5 represents test results at 30° C.

The data was measured with respect to the temperature at various points at different temperatures. The graph was then prepared with the data collected with time plotted at X-axis and temperature at Y-axis. The said graph is represented in FIG. 5.

It was found that invariably the temperature within the container remained constant at all the place of the container over a one hundred and thirty hours.

Example 3

Testing the Performance of the Cold Storage System in Winter

The testing of the performance of the cold storage system was done in winter by placing sensor at various places in the inside and outside the container. The specific points where the sensors were placed.

Figure 6:
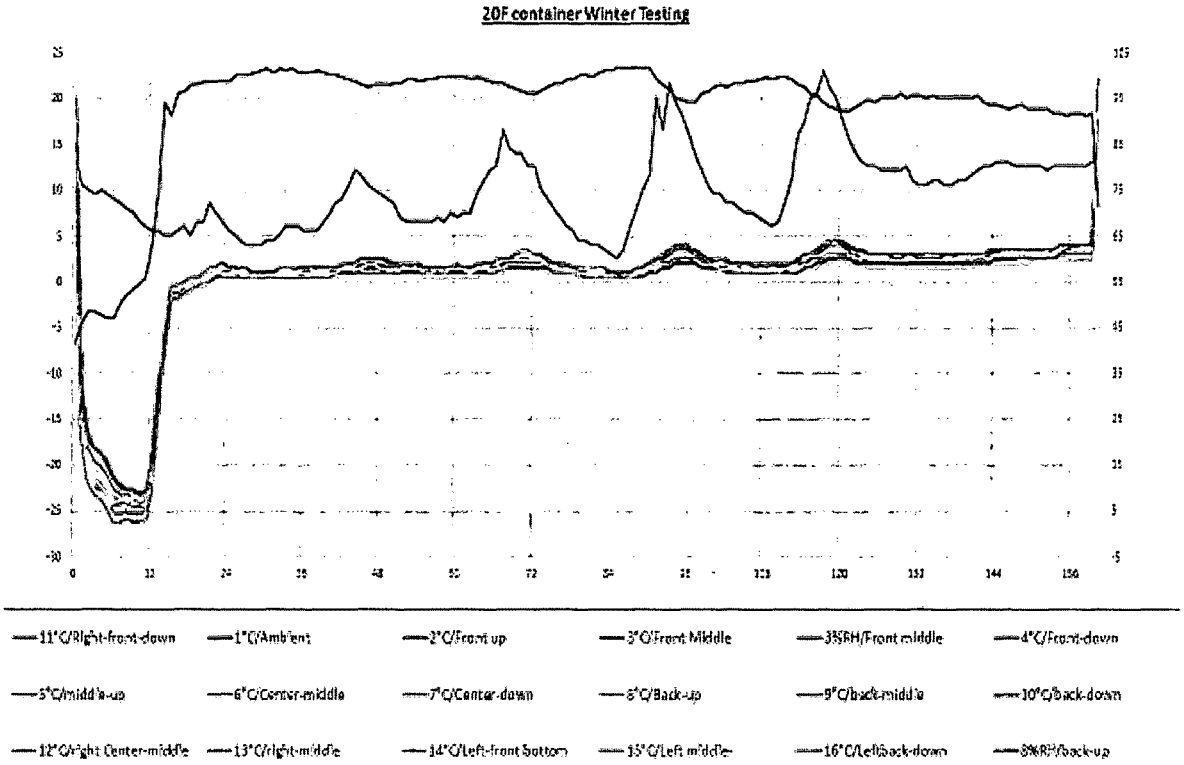
FIG. 6 represents test results in winter

The data was measured with respect to the temperature at various points at different temperatures. The graph was then prepared with the data collected with time plotted at X-axis and temperature at Y-axis. The said graph is represented in FIG. 6.

When conducted test during winters and found a constant temperature at all the location of the container. It was also found that once ambient temperature is lower the support hours are more than summer due to high ambient temperature. Also, even the ambient temperature fluctuation inside is lesser as temperature remain same and impact of ambient temperature fluctuation has very less impact. This indicates that ambient temperature fluctuation would not impact on product temperature also. A conventional refrigerated container could not retained the constant temperature at all the location of the container. The equally distribution of coolant on roof helps to keep same temperature at all the location.

Example 4

Percentage Weight Loss of the Perishables

Cold temperature slows down the chemical and biological processes in foods and the accompanying deterioration and the loss of quality. The storage life of fresh perishable foods such as meats, fish, fruits, and vegetables can be extended by several days by cooling, and by several weeks or months by chilling or freezing. Fruits and vegetables continue to respire and generate heat during storage; most foods freeze over a range of temperatures instead of a single temperature; the quality of frozen foods is greatly affected by the rate of freezing; the velocity of refrigerated air affects the rate of moisture loss from the products addition to the rate of heat transfer, and so forth.

Dehydration, or moisture loss, causes a product to shrivel or wrinkle and lose quality. Therefore, proper measures must be taken during cold storage of food items to minimize moisture loss, which also represents a direct loss of the salable amount. A fruit or vegetable that loses 5 percent moisture, for example, will weigh 5 percent less and will probably be sold at a lower unit price because of loss of quality.

Thus it is necessary parameter for an efficient cold storage system to have minimum weight loss during freezing. From the data provided in Table 1, it is very clear that the percent weight loss due to loss of water in Lettuce, cabbage, tomato and radish is negligible.

TABLE 1

Percentage of Weight loss and water loss in the perishables

| Product | Before Chilled | After Chilled | Weight Loss | % of loss | Average |
|---|---|---|---|---|---|
| Lettuce | 471.7 | 467.0 | −4.7 | −1.0 | −0.9 |
| | 594.9 | 589.8 | −5.1 | −0.9 | |
| | 627.6 | 622.4 | −5.2 | −0.8 | |
| Cabbage | 1069.9 | 1058.7 | −11.2 | −1.0 | −0.9 |
| | 1275.0 | 1263.8 | −11.2 | −0.9 | |
| | 1176.6 | 1165.9 | −10.7 | −0.9 | |
| Tomato | 183.4 | 183.6 | 0.2 | 0.1 | −0.3 |
| | 209.3 | 207.9 | −1.4 | −0.7 | |
| | 185 | 184.2 | −0.8 | −0.4 | |
| Radish | 1299.4 | 1294.5 | −4.9 | −0.4 | −0.4 |
| | 1466.0 | 1460.4 | −5.6 | −0.4 | |
| | 1456.0 | 1450.3 | −5.7 | −0.4 | |
| Spinach | 210.8 | 209.8 | −1.0 | −0.5 | −0.2 |
| | 212.7 | 212.5 | −0.2 | −0.1 | |
| | 236.7 | 236.3 | −0.4 | −0.2 | |

Further, Table 2 provides percentage water loss of the perishable items.

TABLE 2

% of water/moisture loss

| Product | Before Chilled | After Chilled | % of loss |
|---|---|---|---|
| Lettuce | 92.6 | 93.1 | 0.5 |
| Cabbage | 92.4 | 92.3 | −0.1 |
| Tomato | 93.4 | 93.7 | 0.3 |
| Radish | 94.5 | 94.1 | −0.4 |
| Spinach | 92.2 | 92.3 | 0.1 |

From the data provided in Table 2, it is very clear that the percent water loss as a result of chilling or freezing of Lettuce, cabbage, tomato and radish in cold storage is negligible. Thus the cold storage system of the present invention can keep moisture & humidity of the perishable goods intact for longer period of time. It could keep the perishables fresh for longer period of time; means it could stop aging of the perishables and deliver a longer life.

I claim:

1. A system for maintaining a chilled temperature in a cold storage with a roof and a base, the system comprising:

a plurality of coolant arrays uniformly placed on the bottom of the roof of said cold storage;

each coolant array comprising multiple coolant plates arranged in rows and columns in a rectangular configuration;

a compressor generating airflow and being positioned on the bottom of the roof to direct the airflow from a first side of the roof across the plurality of coolant arrays to a second side of the roof and from the second side of the roof towards the base so as to create circulating airflow in a circular pattern from said roof to said base in said cold storage;

said plurality of coolant arrays being placed relative to said compressor such that the airflow generated by the compressor causes freezing of the coolant arrays and the circulating airflow maintains the temperature in said cold storage in a range from −25° C. to +25° C.;

a coolant holder frame configured to facilitate uniform adjustment of said multiple coolant plates in said plurality of coolant arrays, and allow for efficient airflow from top to bottom in said storage;

wherein the base of said cold storage at least partially defines a plurality of channels extending along the base which are configured to pass the air circulated by said compressor and increase the circulation of airflow in said cold storage; and, wherein said cold storage is insulated to increase the thermal insulation coefficient to maintain the desired temperature in said cold storage; and wherein the system is configured to have efficient circulation of airflow in the entire cold storage once the coolant arrays are frozen even when the compressor is stopped afterwards.

2. The system as claimed in claim 1, wherein said plurality of coolant arrays have dimensions 40 cm×30 cm×3.5 cm.

3. The system as claimed in claim 1, wherein there are two coolant arrays placed on the roof of said cold storage.

4. The system as claimed in claim 1, wherein there are three coolant arrays placed on the roof of said cold storage.

5. The system as claimed in claim 1, wherein each array of said plurality of coolant arrays comprises eighty plates.

6. The system as claimed in claim 1, wherein said coolant holder frame is a stainless steel frame.

7. The system as claimed in claim 1, wherein said cold storage is a cold chain logistics, a cold container, a refrigerated container; a chilled cold storage or a frozen cold storage.

* * * * *